United States Patent [19]

Jensen

[11] Patent Number: 4,601,303

[45] Date of Patent: Jul. 22, 1986

[54] ELECTRO-OPTICAL FUEL BLENDING PROCESS

[75] Inventor: Jay E. Jensen, Raritan, N.J.

[73] Assignee: Mobil Oil Corporation, New York, N.Y.

[21] Appl. No.: 685,002

[22] Filed: Dec. 21, 1984

[51] Int. Cl.[4] ..... C10L 1/00

[52] U.S. Cl. ..... 137/3; 137/93

[58] Field of Search ..... 374/17; 137/1, 13, 2, 137/3, 88, 93

[56] References Cited

U.S. PATENT DOCUMENTS

| | | | |
|---|---|---|---|
| 2,707,391 | 5/1955 | McSkimin . | |
| 3,031,880 | 5/1962 | Findlay | 374/17 |
| 3,060,318 | 10/1962 | Ouvrard . | |
| 3,457,772 | 7/1969 | Chassagne et al. . | |
| 3,527,082 | 8/1970 | Pruvot | 374/17 |
| 3,545,254 | 12/1970 | Chassagne | 374/17 |
| 3,734,629 | 5/1973 | Griffiths et al. . | |
| 3,736,431 | 5/1973 | Childs . | |
| 3,818,614 | 6/1974 | Meurer . | |
| 3,885,418 | 5/1975 | Kriebel . | |
| 3,892,485 | 7/1975 | Merritt et al. . | |
| 3,962,041 | 6/1976 | Muller et al. . | |
| 4,003,661 | 1/1977 | Yamano . | |
| 4,077,251 | 3/1978 | Winter . | |
| 4,077,252 | 3/1978 | Stutz et al. . | |
| 4,144,745 | 3/1979 | Sivill . | |
| 4,157,036 | 6/1979 | Kivenson . | |
| 4,214,475 | 7/1980 | Carter et al. . | |
| 4,236,826 | 12/1980 | Yamanishi . | |
| 4,299,119 | 11/1981 | Fitzgerald et al. . | |
| 4,334,424 | 6/1982 | Kepes . | |
| 4,347,734 | 9/1982 | Heinz . | |
| 4,352,983 | 10/1982 | Silvus, Jr. et al. . | |

*Primary Examiner*—Alan Cohan

*Attorney, Agent, or Firm*—Alexander J. McKillop; Michael G. Gilman; Dennis P. Santini

[57] ABSTRACT

An on-site tailored fuel blending process and apparatus is provided for optimizing the blend ratio of a No. 2 fuel oil component and a No. 1 fuel oil component to obtain a fuel mixture which will not freeze, i.e., form wax particles, above a predetermined temperature. Radiant energy, e.g., in the infrared range, from an energy source is transmitted through the sample, and a change in wax crystal concentration of the sample is detected by sensing a predetermined intensity level transmitted by the energy source after the radiant energy therefrom has passed through the sample, or by sensing a predetermined rate of change in the intensity level of the radiant energy after transmission through the sample. The temperature of the sample is measured when the predetermined intensity level or abrupt change thereof is detected. A percentage amount of the No. 1 fuel oil component to be mixed with the No. 2 fuel oil component is determined based on the measured temperature and on stored data representing respective amounts of the fuels to be mixed to obtain a blend which will not freeze above respective fluidity control temperatures. A signal representing this percentage amount is fed to a blending unit, which automatically blends the fuel component in accordance with the indicated percentages.

36 Claims, 3 Drawing Figures

FIG. 1
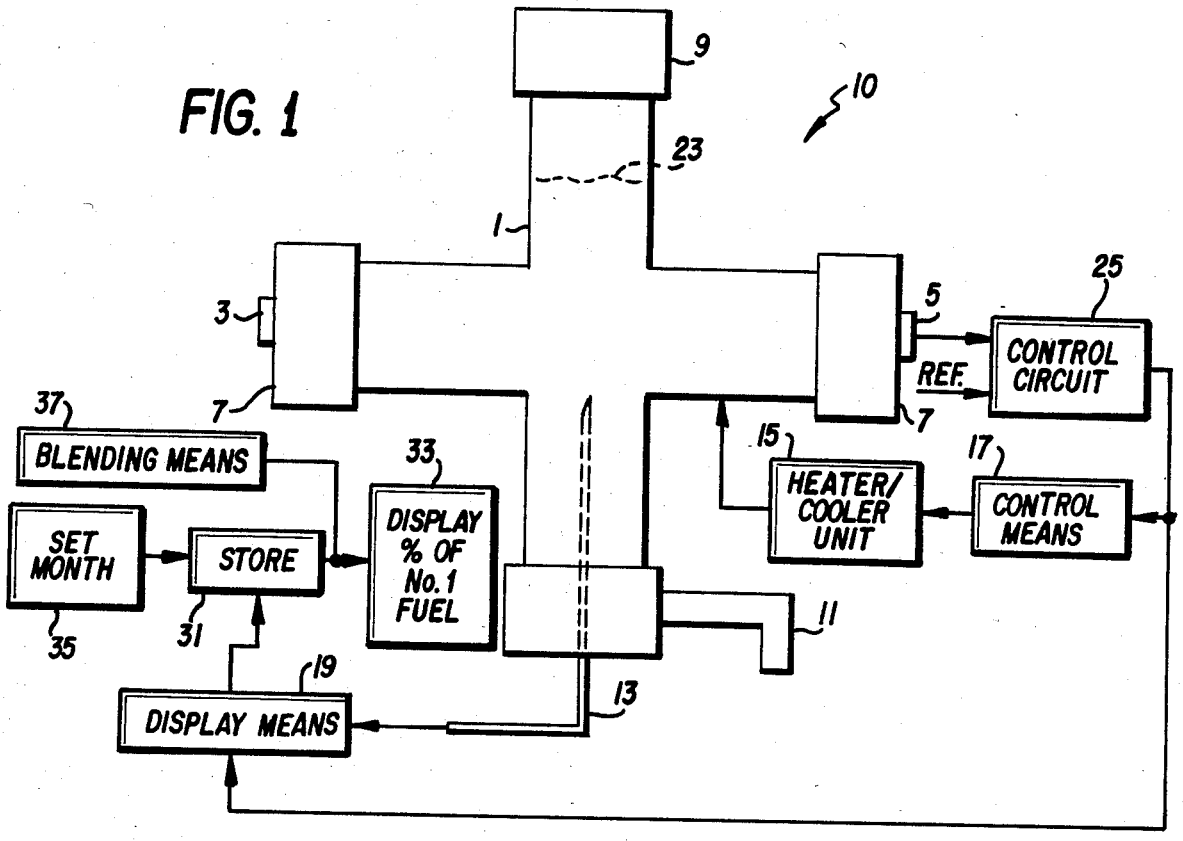
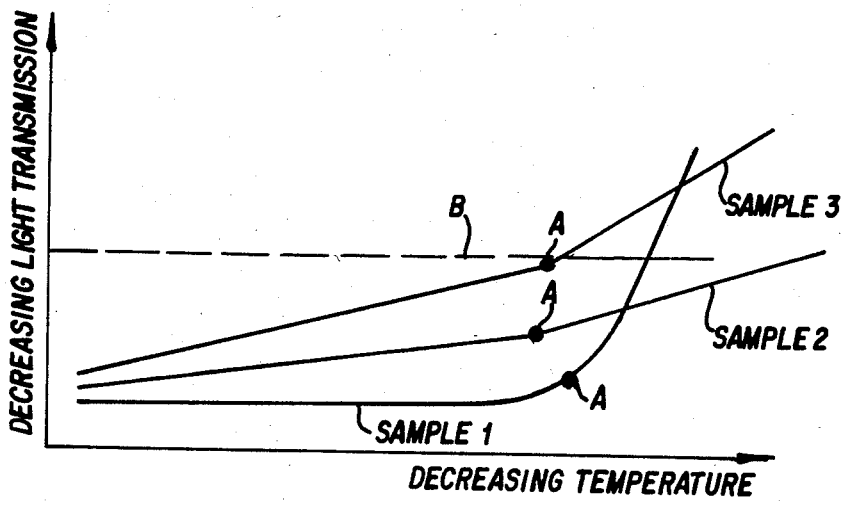
FIG. 2

ELECTRO-OPTICAL FUEL BLENDING PROCESS

BACKGROUND OF THE INVENTION

1. Field of the Invention

The present invention relates to fuel blending processes and apparatus, and more particularly, to a fuel blending process and apparatus for obtaining a fuel mixture which will not freeze or form solid particles, e.g., wax particles, above a predetermined temperature.

2. Description of the Prior Art

During the winter months in northern states, diesel fuel is normally cut back by adding kerosine or No. 1 fuel oil, kerosine or No. 1 heating oil to No. 2 fuel oil or heating oil to reduce problems, such as plugged fuel filters, supply lines and screens, associated with wax crystallization from the diesel fuel blend at low temperatures. In general, an assumed fluidity point or cloud point provides the basis for winter blending as the predictor of low temperature operability limits of diesel equipment. In other words, the temperature at which wax crystals or other solid materials from in the diesel fuel is attempted to be determined in order to ascertain the percentage of No. 1 fuel which must be added to meet the diesel fuel fluidity control temperatures during colder months. In general, as used herein, fluidity refers to fuel in a liquid state without interfering solid or semi-solid, e.g., viscous, particles. Heretofore, diesel fuel blending processes have been based on assumed, arbitrary assumptions regarding the fluidity levels of the No. 2 heating oil component of the ultimate diesel fuel mixture. This occurs when, e.g., a diesel fuel retail distributor buys No. 2 fuel oil from many different suppliers and refineries which supply No. 2 heating oil having differing fluidity levels. For winter blending purposes, the distributor assumes a threshold fluidity level high enough so that all suppliers will supply only product which a freezer or forms solid wax particles below or at this level. While some product will be at this level, most will be below it, the latter resulting in wastage of No. 1 fuel.

Although the actual fluidity level is known at the refinery, this information becomes lost during distribution, thus necessitating the above-described assumed threshold fluidity value. At the refinery level, the actual fluidity value is obtained by a procedure based on the ASTM D-2386 Freeze Point Method or ASTM D-2500 Cloud Pont Method or ASTM D-3117 Wax Appearance Point Method, each of which is a laboratory method for determining the point at which wax crystals in the diesel fuel melt or appear. Determination of freeze point, cloud point or wax appearance point at the refinery level requires cumbersome equipment and a trained technician who must constantly monitor the fuel sample to ascertain visually when melting or wax crystal formation occurs. Thus, these methods are highly subjective and yield non-standard results. Additonally, the cumbersome equipment makes them inconvenient for field use.

Using the conventional methods, during winter months 10–60% kerosine/No. 1 fuel oil is typically blended with No. 2 fuel oil to meet diesel fuel fluidity requirements. The percentage of No. 1 fuel (kerosine) added is dictated by monthly winter blending guidelines specific for each terminal and is based on historical weather data and an assumed fluidity level, as described above, of the base No. 2 fuel oil. The use of an inexact, assumed No. 2 fuel fluidity point frequently leads to overblending in some instances, resulting in No. 1 fuel wastage, and underblending in others, resulting in fuel line, filter and screen clogging.

No fuel blending process or apparatus has heretofore provided on-site precise, tailored diesel fuel blending for optimizing the blend ratio of the component fuels forming the ultimate fuel mixture in order to obtain a fuel mixture which will not freeze or form solid particles above a predetermined temperature.

Accordingly, it is an object of the present invention to provide a tailored diesel fuel blending process and apparatus to fulfill the above-described needs heretofore unmet by prior art systems.

It is also an object of the present invention to provide a tailored, diesel fuel blending process and apparatus whereby reliance on assumed fluidity levels of a No. 2 fuel oil component can be avoided by an on-site actual determination of the fluidity level of the No. 2 fuel oil component.

It is also an object of the present invention to provide an opto-electrical, tailored, diesel fuel blending process and apparatus whereby substantial savings of required No. 1 fuel oil can be obtained, and whereby more No. 1 fuel oil can be made available for upgrading to, e.g., jet fuel.

It is yet another object of the present invention to provide an electro-optical, tailored, diesel fuel blending process and apparatus whereby a high density diesel fuel blend with higher BTU content and better fuel economy is provided.

It is a further object of the present invention to provide a reliable automatic, opto-electrical, tailored fuel blending process and apparatus.

SUMMARY OF THE INVENTION

According to the present invention, a process is provided for blending a fuel which includes a No. 2 fuel oil component and a No. 1 fuel oil component, with the No. 1 fuel oil component providing a fuel mixture which will not form solid particles above a predetermined temperature. Such process includes the steps of (a) varying a temperature of a sample of the No. 2 fuel oil component, (b) transmitting radiant energy from an energy source through the sample, and (c) detecting a predetermined radiant energy intensity level transmitted by the energy source after the aforesaid radiant energy has passed through the No. 2 fuel oil component sample, or detecting a rate of change in the aforesaid intensity level at least as great as a predetermined rate of change thereof.

The process also includes the steps of (d) measuring a temperature of the No. 2 fuel oil component sample when the predetermined energy intesity level or rate of change thereof is detected in step (c), (e) determining a percentage amount of the No. 1 fuel oil component to be mixed with the No. 2 fuel oil component, based on the temperature detected in step (d) to obtain a fuel mixture which will not form solid particles above a predetermined temperature, and (f) blending the No. 1 and No. 2 fuel oil components in accordance with the percentage amount determined in step (e). Step (a) can include lowering the temperature of the No. 2 fuel oil component sample from a predetermined higher temperature to successively lower temperatures until the predetermined energy intensity level or rate of change thereof is detected. Alternatively, step (a) can include raising the temperature of the No. 2 fuel oil component sample from a predetermined lower temperature to successively higher temperatures until the predetermined energy intensity level or rate of change thereof is detected.

The predetermined energy intensity level can be sensed by placing a sample of the No. 1 fuel oil component in a sample chamber having an energy source disposed on one end and radiant energy detection means disposed on an opposite end of the sample chamber, with the energy source emitting radiant energy having a predetermined initial intensity and passing through the No. 1 fuel oil component sample in the sample chamber and impinging on the radiant energy detection means. The detection means provides an output indicating the attenuated intensity of the radiant energy after passing through the No. 1 fuel oil component sample in the sample chamber, while electro-optical circuit means compares the output of the detection means with a reference value corresponding to the aforesaid predetermined intensity level to generate an outut signal upon substantial equivalence between the reference value and the output of the detection means. Alternatively, to detect a predetermined rate of change in the intensity level, as defined above, the electro-optical circuit means can differentiate the detector output signal to generate a differentiated output signal and compare this latter signal with a reference value corresponding to the predetermined rate of change in intensity level.

The process can further comprise measuring a temperature of the No. 2 fuel oil component sample while the No. 2 fuel oil component sample is being cooled to successively lower temperatures, displaying the measured temperature on a display device and locking the displayed temperature on the display device upon a detection of a predetermined intensity level or rate of change thereof in step (c).

The process can alternatively further comprise measuring a temperature of the No. 2 fuel oil component while the No. 2 fuel oil component is being heated to succesively higher temperatures, displaying the measured temperature on a display device and locking the displayed temperature on a display device upon a detection of a predetermined intensity level or rate of change thereof in step (c).

The process can further comprise raising the temperature of the No. 2 fuel oil component to an ambient temperature in response to a detection of a predetermined intensity level or rate of change thereof in step (c).

Also according to the present invention, apparatus is provided for use in blending a fuel which includes a first fuel oil component and a second fuel oil component, with the first fuel oil component being used to produce a fuel mxture which will not freeze or form solid wax particles above a predetermined temperature and with the first and second fuel oil components having different fuel oil numbers. Such apparatus includes (a) means for varying a temperature of a sample of the second fuel oil component, (b) energy source means for transmitting radiant energy through the second fuel oil component sample, and (c) detection means for detecting a predetermined intensity of radiant energy transmitted by the energy source after the radiant energy has passed through the second fuel oil component sample, or for detecting a predetermined rate of change in an intensity level of radiant energy transmitted as aforesaid which is at least as great as a predetermined rate of change thereof.

The apparatus also includes (d) means responsive to a detection of the predetermined light intensity level or rate of change thereof, for generating a temperature signal representing the temperature of the second fuel oil component sample when the predetermined intensity level or rate of change thereof is detected. The apparatus also includes (e) storage means storing data representing respective percentage amounts of the first fuel oil component to be mixed with the second fuel oil component to obtain a fuel mixture which will not freeze above respective given fluidity control temperatures. The storage means receives a first input comprising the temperature signal and a second input comprising data representing a particular aforesaid given fluidity control temperature. The storage means generates an output responsive to the first and second inputs for indicating a particular percentage amount of the first fuel oil component to be mixed with the second fuel oil component to obtain a fuel mixture which will not form solid particles above the aforesaid particular fluidity control temperature.

The apparatus can also include means receiving the storage means output for blending the first and second fuel oil components in accordance with the required percentage amount. The second input to the storage means can comprise month data. First display means can receive the output from the storage means for displaying the particular percentage amount. The blending means can comprise a first reservoir for containing the first fuel oil component, a second reservoir for containing the second fuel oil component, and control means responsive to the storage means output to control first valve means associated with the first reservoir and second valve means associated with the second reservoir to desposit fuel oil therefrom in a third resevoir in amounts in accordance with the indicated particular percentage amount.

BRIEF DESCRIPTION OF THE DRAWINGS

The above and other objects, advantages and features of the present invention will be more fully understood when considered in conjunction with the following drawings, of which:

FIG. 1 illustrates fuel blending apparatus according to the present invention;

FIG. 2 is a graph illustrating the relationship between temperature and degree of light transmission through fuel oil samples.

DETAILED DESCRIPTION OF THE INVENTION

Figure 3:
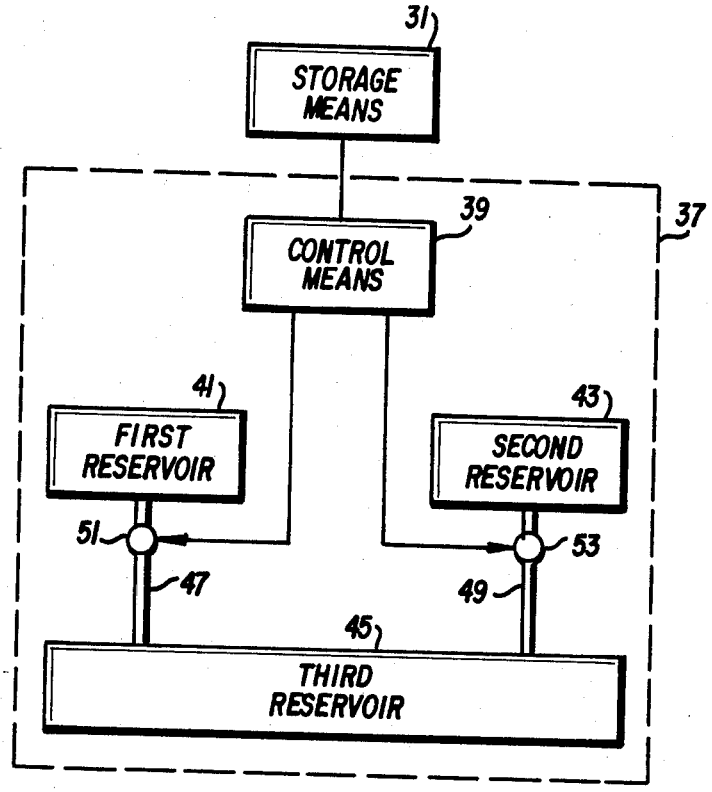
FIG. 3 illustrates additional aspects of the fuel blending apparatus of FIG. 1.

FIG. 1 shows an embodiment of an electro-optical fuelblending apparatus which uses a sample chamber 1 having a light or radiant energy source 3 on one end thereof and a light or radiant energy detection means 5 on an opposite end of chamber 1. Source 3, which may be, e.g., a light emitting diode operating in the infrared range, passes a light beam through chamber 1 to impinge upon detector 5. Detector 5 may be, e.g., a phototransistor which detects the intensity of the energy transmitted through the sample in chamber 1 to monitor transmission blockage. Detector means 5 is positioned to view observation windows 7 located on opposite ends of chamber 1. A removable cap 9 is provided for loading the sample in chamber 1, and a removable drain 11 allows removal of the sample. Reference numeral 23 indicates the sample level within chamber 1. Thermocouple 13 extends into chamber 1 to measure continuously the temperature of the sample therein, while the temperature of the sample is varied. The measured temperature of the sample is continuously displayed on display means 19, which is preferably a digital display device.

A heater/cooler unit 15 heats or cools the sample within chamber 1 as desired. Unit 15 can be a solid state electronic thermo-electric cooler or refrigeration system capable of providing fluidity point or cloud point measurements down to the lowest temperature within the required practical range necessary for present purposes, e.g., −25° F. although such devices are capable of cooling to even lower temperatures. Unit 15 may be clamped to chamber 1 and provides heating or cooling, depending upon the direction of electrical current flow through the device. Control circuit 17 causes heater/-cooler unit 15 to cool the sample until detection means 5 detects energy transmission through the sample having a predetermined attenuated intensity.

Electro-optical circuit means 25 compares the output of detector means 5 with a reference signal corresponding to the predetermined attenuated intensity to generate an output signal which indicates solid particle formation, e.g., wax crystallization, upon equivalence of the reference signal and the output of detector means 5. This reference signal is, e.g., a voltage signal which is capable of being calibrated to provide the requisite comparison value. Alternatively, circuit means 25 can include a differentiation circuit to differentiate the output of detector 5 to generate a differentiated output signal. This latter signal is then compared with a reference signal e.g., a voltage signal calibrated as above, which has a magnitude corresponding to the predetermined rate of change in intensity level, indicating wax formation. Upon equivalence between the magnitude of the differentiated output signal and the magnitude of the reference signal, a wax crystallization output signal is generated. In either case, the crystallization output signal is fed to temperature display means 19 to lock the digital temperature display at the wax formation temperature. Additionally, the crystallization output signal is sent to control circuit 17, which switches heater/-cooler unit 15 to the heating mode to begin heating sample chamber 1 back to ambient temperature to prepare it for the next test. Radiant energy source 3 emits a beam having a predetermined initial intensity prior to passing through the fuel sample, with this predetermined initial intensity determining the required attenuated intensity to indicate wax formation. In other words, the initial intensity of the beam emitted by source 1 can be varied, with the attenuated intensity which indicates wax crystallization being a function thereof. It should be noted that while hydrocarbon fuel oils form solid wax particles at low temperatures, the present invention is equally applicable to blending of other fuels where it is necessary to determine with precision the temperature at which freezing or formation of solid particles occurs, where such solid particles might be other than or in addition to wax particles. It should be noted that the term "solid" refers to particles which would tend to interfere with use of the fuel for its intended purpose. Thus, "solid" encompasses semi-solid, e.g., viscous, materials.

FIG. 2 is a graph illustrating the degree of radiant energy transmission through various samples within chamber 1 as a function of temperature. The curves assume a constant initial intensity of emitted radiant energy from source 3. Each point A represents the level of attenuated radiant energy intensity or rate of change in attenuation, indicating wax formation. It should be noted that at an attenuation level denoted by reference line B in FIG. 2, solid wax particles have formed in each sample.

The novel method of the present invention provides for blending a diesel or other fuel which includes a No. 2 fuel oil component and a No. 1 fuel oil component, with the No. 1 fuel oil component functioning to yield a fuel mixture which will not freeze or form solid wax particles above a predetermined temperature. Th process includes varying the temperature of a sample of the No. 2 fuel oil component, transmitting radiant energy from an energy source through the sample, and detecting a change in wax crystal or other solid particle concentration of the No. 2 fuel oil component sample by detecting a predetermined degree of energy transmission attenuation through the No. 2 fuel oil component sample, or by sensing at least a predetermined rate of change in the intensity of the energy transmitted through the sample. The temperature of the No. 2 fuel oil component sample is measured when the predetermined degree of transmission attenuation or rate of change thereof is detected. A percentage amount of the No. 1 fuel oil component to be mixed with the No. 2 fuel oil component is then determined based on the temperature determined as above, to obtain a fuel mixture which will not freeze or form solid wax particles above a predetermined temperature. The No. 1 and No. 2 fuel oil components are then blended in accordance with the percentage amount determined as above to obtain the required fuel mixture.

As used herein, the term No. 1 fuel oil is intended to be a generic term which includes kerosine and No. 1 heating oil; i.e., the latter are specific types of No. 1 fuel oil. Similarly. the generic term No. 2 fuel oil encompasses No. 2 heating oils.

The percentage of No. 1 fuel oil component, which can be kerosine, to be added can be determined using a look-up table, such as those shown in Tables 1 and 2 below, or any other storage means for recording data indicating the percentage of No. 1 fuel to be added as a function of the measured fluidity point or cloud point temperature of the No. 2 fuel oil component. These data will, of course, vary depending on the geographic area and the month in which the fuel is to be used. Table 1 may be, for example, for a particular area for the given range of months, while Table 2 may be for another area for the months, as shown. The fluidity control temperature in these tables can be based on freeze point, cloud point or wax appearance point.

TABLE 1

Typical Diesel Fuel Fluidity Blending Table

| | NOV | DEC | JAN | FEB | MAR |
|---|---|---|---|---|---|
| | Fluidity Control Temperature, °F. | | | | |
| Measured Cloud Point Temperature, °F. | +20 | +5 | −5 | −5 | +10 |
| | % No. 1 Fuel to be Added | | | | |
| +20 | 0 | 60 | 80 | 80 | 45 |
| 19 | 0 | 55 | 75 | 75 | 40 |
| 18 | 0 | 55 | 75 | 75 | 35 |
| 17 | 0 | 50 | 75 | 75 | 35 |
| 16 | 0 | 45 | 70 | 70 | 30 |
| 15 | 0 | 45 | 70 | 70 | 25 |
| 14 | 0 | 40 | 65 | 65 | 20 |
| 13 | 0 | 35 | 65 | 65 | 15 |
| 12 | 0 | 35 | 60 | 60 | 10 |
| 11 | 0 | 30 | 60 | 60 | 5 |

TABLE 1-continued

| Typical Diesel Fuel Fluidity Blending Table | | | | | |
|---|---|---|---|---|---|
| | NOV | DEC | JAN | FEB | MAR |
| | Fluidity Control Temperature, °F. | | | | |
| Measured Cloud Point Temperature, °F. | +20 | +5 | −5 | −5 | +10 |
| | % No. 1 Fuel to be Added | | | | |
| 10 | 0 | 25 | 55 | 55 | 0 |
| 9 | 0 | 20 | 55 | 55 | 0 |
| 8 | 0 | 15 | 50 | 50 | 0 |
| 7 | 0 | 10 | 50 | 50 | 0 |
| 6 | 0 | 5 | 45 | 45 | 0 |
| 5 | 0 | 0 | 40 | 40 | 0 |
| 4 | 0 | 0 | 40 | 40 | 0 |
| 3 | 0 | 0 | 35 | 35 | 0 |
| 2 | 0 | 0 | 30 | 30 | 0 |
| 1 | 0 | 0 | 30 | 30 | 0 |
| 0 | 0 | 0 | 25 | 25 | 0 |
| −1 | 0 | 0 | 20 | 20 | 0 |
| −2 | 0 | 0 | 15 | 15 | 0 |
| −3 | 0 | 0 | 10 | 10 | 0 |
| −4 | 0 | 0 | 5 | 5 | 0 |
| −5 | 0 | 0 | 0 | 0 | 0 |

TABLE 2

| Typical Diesel Fuel Fluidity Blending Table | | | | | |
|---|---|---|---|---|---|
| | NOV | DEC | JAN | FEB | MAR |
| | Fluidity Control Temperature, °F. | | | | |
| Measured Cloud Point Temperature, °F. | +20 | +10 | 0 | +5 | +15 |
| | % No. 1 Fuel to be Added | | | | |
| +20 | 20 | 45 | 70 | 60 | 25 |
| 19 | 20 | 40 | 65 | 55 | 20 |
| 18 | 20 | 35 | 65 | 55 | 20 |
| 17 | 20 | 35 | 65 | 50 | 20 |
| 16 | 20 | 30 | 60 | 45 | 20 |
| 15 | 20 | 25 | 60 | 45 | 20 |
| 14 | 20 | 20 | 55 | 40 | 20 |
| 13 | 20 | 20 | 55 | 35 | 20 |
| 12 | 20 | 20 | 50 | 35 | 20 |
| 11 | 20 | 20 | 45 | 30 | 20 |
| 10 | 20 | 20 | 45 | 25 | 20 |
| 9 | 20 | 20 | 40 | 20 | 20 |
| 8 | 20 | 20 | 35 | 20 | 20 |
| 7 | 20 | 20 | 35 | 20 | 20 |
| 6 | 20 | 20 | 30 | 20 | 20 |
| 5 | 20 | 20 | 25 | 20 | 20 |
| 4 | 20 | 20 | 20 | 20 | 20 |
| 3 | 20 | 20 | 20 | 20 | 20 |
| 2 | 20 | 20 | 20 | 20 | 20 |
| 1 | 20 | 20 | 20 | 20 | 20 |
| 0 | 20 | 20 | 20 | 20 | 20 |

As shown in FIG. 1, Tables, such as 1 or 2, can be conveniently stored in a digital storage device 31, such as a ROM, with a percentage being read out on display 33 from storage based on the temperature value from display means 19 as one input to the storage device 31, and month data as another input thereto. The month data could be set with a settable input device.

Additionally, an output representing the necessary blend percentages of the fuel components can be provided from storage device 31 to blending means 37, which automatically blends the fuel components in accordance with these percentages. As shown in FIG. 3, blending means 37 can comprise a control means 39 which receives a percentage indicating output from storage device 31. Responsive to this output from storage device 31, control means 39 provides control signal outputs to first and second reservoirs 41 and 43 which contain No. 1 fuel oil and No. 2 fuel oil, respectively. These control signals operate valve means 51 and 53 on output lines 47 and 49 associated with reservoirs 41 and 43, respectively. Valve means 51 and 53 open in varying degrees in response to the aforesaid control signals to deposit fuel oil from reservoirs 41 and 43 in third reservoir 45 in amounts in accordance with the indicated percentage amounts required to obtain the desired fuel blend.

The temperature of the No. 2 fuel oil component can be lowered from a predetermined higher temperature, e.g., ambient temperature or any other temperature which is above the fluidity point temperature of the sample, to successively lower temperatures until the predetermined degree of transmission attenuation or rate of change in transmitted energy intensity is detected. Alternatively, the temperature of the No. 2 fuel oil component can be raised from a predetermined lower temperature (below the fluidity point temperature of the sample) to successively higher temperatures until the predetermined degree of transmission attenuation or rate of change in transmitted energy intensity is detected.

The predetermined degree of transmission attenuation or rate of change in transmitted energy intensity can be sensed by placing the No. 2 fuel oil component sample in a sample chamber, such as that shown in FIG. 1. The temperature of the No. 2 fuel oil component can be continuously or intermittently measured while this component is being cooled, with the measured temperature being displayed on the display device. The displayed temperature can be locked upon a detection of a change in wax crystal concentration, as described above. Also, the temperature of the No. 2 fuel oil component can be raised to ambient temperature upon detection of at least a predetermined rate of change in wax crystal concentration. The sample is preferably raised to ambient temperature, as opposed to evacuating the chamber after the test is completed, in order to prevent fogging of the chamber windows and to eliminate the thermal history of the sample. For example, if the sample temperature is raised merely to, e.g., 20° F., the thermal condition of the sample is still affected by the previous cooling. Alternatively, the temperature of the No. 2 fuel oil component can be continuously measured while the No. 2 fuil oil component is being heated, with the measured temperature being displayed on a display device. The displayed temperature can be locked on the display device upon detection of a change in wax crystal concentration, and the temperature of the No. 2 fuel oil component can be raised to ambient temperature also upon detection of a change in wax crystal concentration, as above.

The above-described description and the accompanying drawings are merely illustrative of the application of the principals of the present invention and are not limiting. Numerous other arrangements which embody the principles of the invention and which fall within its spirit and scope may be readily devised by those skilled in the art. Accordingly, the invention is not limited by the foregoing description, but is only limited by the scope of the appended claims.

I claim:

1. A process for blending a fuel which includes a first fuel component and a second fuel component, said first fuel component being used to produce a fuel mixture which will not form solid particles above a predetermined temperature, said process comprising the steps of:

(a) varying a temperature of a sample of said second fuel component;

(b) transmitting radiant energy from an energy source through said second fuel component sample;

(c) detecting a predetermined intensity level of radiant energy transmitted by said source after said radiant energy has passed through said second fuel component sample;

(d) obtaining a temperature measurement indicating a temperature of said second fuel component sample when said predetermined intensity level is detected;

(e) determining a percentage amount of said first fuel component to be mixed with said second fuel component based on said temperature detected in step (d) to obtain a fuel mixture which will not form solid particles above a predetermined temperature; and (f) blending said first and second fuel components in accordance with said percentage amount determined in step (e).

2. The process as recited in claim 1, wherein said temperature measurement indicating a temperature of said second fuel component sample is obtained by measuring a temperature of said second fuel component sample.

3. A process as recited in claim 1, wherein said first fuel component is a No. 1 fuel oil component and said second fuel component is a No. 2 fuel oil component said first and second fuel oil components having different fuel oil numbers.

4. The process as recited in claim 3, wherein a temperature of said No. 2 fuel oil component sample is lowered from a predetermined higher temperature to successively lower temperatures until said predetermined intensity level is detected in step (c).

5. The process as recited in claim 3, wherein a temperature of said No. 2 fuel oil component is raised from a predetermined lower temperature to successively higher temperatures until said predetermined intensity level is detected in step (c).

6. The process as recited in claim 3, wherein said predetermined intensity level is detected by placing said No. 2 fuel oil component sample in a sample chamber having said source disposed on one end and radiant energy detection means disposed on an opposite end of said sample chamber, said source emitting radiant energy having a predetermined initial intensity prior to passing through said No. 2 fuel oil component in said sample chamber, radiant energy from said source impinging on said detection means, said detection means providing an output signal representing an intensity of radiant energy impinging thereon, and comparing said output of said detection means with a reference signal corresponding to said predetermined intensity level to generate an output signal upon equivalence between said reference value and said output of said detection means.

7. The process as recited in claim 3, further comprising measuring a temperature of said No. 2 fuel oil component sample while said No. 2 fuel oil component sample is being cooled to successively lower temperatures, displaying said measured temperature on a display device and locking said displayed temperature in response to a detection of a said predetermined intensity level in step (c).

8. The process as recited in claim 3, further comprising measuring a temperature of said No. 2 fuel oil component sample while said No. 2 fuel oil component sample is being heated to successively higher temperatures, displaying said measured temperature on a display device and locking said displayed temperature upon a detection of a said predetermined intensity level in step (c).

9. The process as recited in claim 7, further comprising raising said temperature of said No. 2 fuel oil component sample to an ambient temperature upon a detection of a said predetermined intensity level in step (c).

10. The process as recited in claim 8, further comprising raising said temperature of said No. 2 fuel oil component sample to an ambient temperature upon a detection of a said predetermined intensity level in step (c).

11. The process as recited in claim 3, wherein said fuel mixture is a diesel fuel mixture and said No. 1 fuel oil component is kerosine.

12. A process for blending a fuel which includes a first fuel component and a second fuel component, said first fuel component being used to produce a fuel mixture which will not form solid particles above a predetermined temperature, said process comprising the steps of:

(a) varying a temperature of a sample of said second fuel component;

(b) transmitting radiant energy from an energy source through said second fuel component sample;

(c) detecting a rate of change in an intensity level of radiant energy transmitted by said source at least as great as a predetermined rate of change thereof after said radiant energy has passed through said second fuel component sample;

(d) obtaining a temperature measurement indicating a temperature of said second fuel component sample when at least said predetermined rate of change in intensity level is detected;

(e) determining a percentage amount of said first fuel component to be mixed with said second fuel component based on said temperature detected in step (d) to obtain a fuel mixture which will not form solid particles above a predetermined temperature; and (f) blending said first and second fuel components in accordance with said percentage amount determined in step (e).

13. The process as recited in claim 12, wherein said temperature measurement indicating a temperature of said second fuel component sample is obtained by measuring a temperature of said second fuel component sample.

14. A process as recited in claim 12, wherein said first fuel component is a No. 1 fuel oil component and said second fuel component is a No. 2 fuel oil component, said first and second fuel oil components having different fuel oil numbers.

15. The process as recited in claim 14, wherein a temperature of said No. 2 fuel oil component sample is lowered from a predetermined higher temperature to successively lower temperatures until said predetermined rate of change in intensity level is detected in step (c).

16. The process as recited in claim 14, wherein a temperature of said No. 2 fuel oil component is raised from a predetermined lower temperature to successively higher temperatures until said predetermined rate of change in intensity level is detected in step (c).

17. The process as recited in claim 14, wherein said predetermined rate of change in intensity level is detected by placing said No. 2 fuel oil component sample in a sample chamber having said source disposed on one end and radiant energy detection means disposed on an opposite end of said sample chamber, said source emitting radiant energy having a predetermined initial intensity prior to passing through said No. 2 fuel oil component in said sample chamber, radiant energy from said source impinging on said detection means, said detection means providing a detector output signal representing an intensity of radiant energy impinging thereon, differentiating said detector output signal to generate a differentiated output signal and comparing said differentiated output signal with a reference value corresponding to said predetermined rate of change in intensity level to generate an output signal upon equivalence between said reference value and said differentiated output.

18. The process as recited in claim 14, further comprising measuring a temperature of said No. 2 fuel oil component sample while said No. 2 fuel oil component sample is being cooled to successively lower temperatures, displaying said measured temperature on a display device and locking said displayed temperature in response to a detection of a said predetermined rate of change in intensity level in step (c).

19. The process as recited in claim 14, further comprising measuring a temperature of said No. 2 fuel oil component sample while said No. 2 fuel oil component sample is being heated to successively higher temperatures, displaying said measured temperature on a display device and locking said displayed temperature upon a detection of a said predetermined rate of change in intensity level in step (c).

20. The process as recited in claim 18, further comprising raising said temperature of said No. 2 fuel oil component sample to an ambient temperature upon a detection of a said predetermined rate of change in intensity level in step (c).

21. The process as recited in claim 19, further comprising raising said temperature of said No. 2 fuel oil component sample to an ambient temperature upon a detection of a said predetermined rate of change in intensity level in step (c).

22. The process as recited in claim 14, wherein said fuel mixture is a diesel fuel mixture and said No. 1 fuel oil component is kerosine.

23. An apparatus for use in blending a fuel which includes a first fuel component and a second fuel component, said first fuel component being used to produce a fuel mixture which will not form solid particles above a predetermined temperature, said apparatus comprising:

(a) means for varying a temperature of a sample of said second fuel component;

(b) energy source means for transmitting radiant energy through said second fuel component sample;

(c) detection means for detecting a predetermined intensity of radiant energy transmitted by said source after said radiant energy has passed through said second fuel component sample;

(d) means responsive to a detection of said predetermined intensity level for generating a temperature signal representing the temperature of said second fuel component sample when said predetermined intensity level is detected; and (e) storage means storing data representing respective percentage amounts of said first fuel component to be mixed with said second fuel component to obtain a fuel mixture which will not form solid particles above respective given fluidity control temperatures, said storage means receiving a first input comprising said temperature signal and a second input comprising a data signal representing a particular said given fluidity control temperature, said storage means generating an output signal responsive to said first and second inputs for indicating a particular percentage amount of said first fuel component to be mixed with said second fuel component to obtain a fuel mixture which will not form solid particles above said particular fluidity control temperature.

24. The apparatus as recited in claim 23, wherein said first fuel component is a No. 1 fuel oil component and said second fuel component is a No. 2 fuel oil component, said first and second fuel oil components having different fuel oil numbers.

25. The apparatus as recited in claim 24, further comprising means receiving said storage means output signal for blending said first and second fuel oil components in accordance with said percentage amount.

26. The apparatus as recited in claim 24, wherein said second input comprises month data.

27. The apparatus as recited in claim 24, further comprising first display means receiving said output signal from said storage means for displaying said particular percentage amount.

28. The apparatus as recited in claim 25, wherein said blending means comprises a first reservoir for containing said first fuel oil component, a second reservoir for containing said second fuel oil component, and control means responsive to said storage means output signal for controlling first valve means associated with said first reservoir and second valve means associated with said second reservoir to deposit fuel oil therefrom in a third reservoir in amounts in accordance with said particular percentage amount.

29. An apparatus for use in blending a fuel which includes a first fuel component and a second fuel component, said first fuel component being used to produce a fuel mixture which will not form solid particles above a predetermined temperature, said apparatus comprising:

(a) means for varying a temperature of a sample of said second fuel component;

(b) energy source means for transmitting radiant energy through said second fuel component sample;

(c) detection means for detecting a predetermined rate of change in an intensity level of radiant energy transmitted by said source at least as great as a predetermined rate of change thereof after said radiant energy has passed through said second fuel component sample;

(d) means responsive to a detection of at least said predetermined rate of change in intensity level for generating a temperature signal representing the temperature of said second fuel component sample when at least said predetermined rate of change in intensity level is detected; and (e) storage means storing data representing respective percentage amounts of said first fuel component to be mixed with said second fuel component to obtain a fuel mixture which will not form solid particles above respective given fluidity control temperatures, said storage means receiving a first input comprising said temperature signal and a second input comprising a data signal representing a particular said given fluidity control temperature, said storage means generating an output signal responsive to said first and second inputs for indicating a particular percentage amount of said first fuel component to be mixed with said second fuel component to obtain a fuel mixture which will not form solid particles above said particular fluidity control temperature.

30. The apparatus as recited in claim 29, wherein said first fuel component is a No. 1 fuel oil component and said second fuel component is a No. 2 fuel oil component, said first and second fuel oil components having different fuel oil numbers.

31. The apparatus as recited in claim 30, further comprising means receiving said storage means output signal for blending said first and second fuel oil components in accordance with said percentage amount.

32. The apparatus as recited in claim 30, wherein said second input comprises month data.

33. The apparatus as recited in claim 30, further comprising first display means receiving said output signal from said storage means for displaying said particular percentage amount.

34. The apparatus as recited in claim 31, wherein said blending means comprises a first reservoir for containing said first fuel oil component, a second reservoir for containing said second fuel oil component, and control means responsive to said storage means output signal for controlling first valve means associated with said first reservoir and second valve means associated with said second reservoir to deposit fuel oil therefrom in a third reservoir in amounts in accordance with said particular percentage amount.

35. An apparatus for use in blending a fuel which includes a first fuel component and a second fuel component, said first fuel component being used to produce a fuel mixture which will not form solid particles above a predetermined temperature, said apparatus comprising:

(a) means for varying a temperature of a sample of said second fuel component;

(b) energy source means for transmitting radiant energy through said second fuel component sample;

(c) detection means for detecting a predetermined intensity of radiant energy transmitted by said source after said radiant energy has passed through said second fuel component sample;

(d) means responsive to a detection of said predetermined intensity level for generating a temperature signal representing the temperature of said second fuel component sample when said predetermined intensity level is detected; and (e) percentage indicating means receiving a first input comprising said temperature signal and a second input comprising a data signal representing a particular fluidity control temperature, said percentage indicating means generating an output signal responsive to said first and second inputs for indicating a particular percentage amount of said first fuel component to be mixed with said second fuel component to obtain a fuel mixture which will not form solid particles above said particular fluidity control temperature.

36. An apparatus for use in blending a fuel which includes a first fuel component and a second fuel component, said first fuel component being used to produce a fuel mixture which will not form solid particles above a predetermined temperature, said apparatus comprising:

(a) means for varying a temperature of a sample of said second fuel component;

(b) energy source means for transmitting radiant energy through said second fuel component sample;

(c) detection means for detecting a predetermined rate of change in an intensity level of radiant energy transmitted by said source at least as great as a predetermined rate of change thereof after said radiant energy has passed through said second fuel component sample;

(d) means responsive to a detection of at least said predetermined rate of change in intensity level for generating a temperature signal representing the temperature of said second fuel component sample when at least said predetermined rate of change in intensity level is detected; and (e) percentage indicating means receiving a first input comprising said temperature signal and a second input comprising a data signal representing a particular fluidity control temperature, said percentage indicating means generating an output signal responsive to said first and second inputs for indicating a particular percentage amount of said first fuel component to be mixed with said second fuel component to obtain a fuel mixture which will not form solid particles above said particular fluidity control temperature.

* * * * *

UNITED STATES PATENT AND TRADEMARK OFFICE

CERTIFICATE OF CORRECTION

PATENT NO. : 4,601,303

DATED : July 22, 1986

INVENTOR(S) : Jay E. Jensen

It is certified that error appears in the above-identified patent and that said Letters Patent is hereby corrected as shown below:

Column 1, line 38, "a freezer" should be --freezes--

Column 3, line 54, "mxture" should be --mixture--

Column 6, line 13, "Th" should be --The--

Signed and Sealed this

Sixth Day of January, 1987

*Attest:*

DONALD J. QUIGG

*Attesting Officer*

*Commissioner of Patents and Trademarks*